US008245374B2

(12) United States Patent
Heffe et al.

(10) Patent No.: US 8,245,374 B2
(45) Date of Patent: Aug. 21, 2012

(54) ROLLER BURNISHING MACHINE FOR CRANKSHAFTS

(75) Inventors: Roland Heffe, Korschenbroich (DE); Alfred Heimann, Aachen (DE); Theo Nijssen, CJ Beesel (NL); Frank Risters, Erkelenz (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 690 days.

(21) Appl. No.: 11/887,595

(22) PCT Filed: Apr. 3, 2006

(86) PCT No.: PCT/EP2006/003016

§ 371 (c)(1),
(2), (4) Date: Aug. 24, 2009

(87) PCT Pub. No.: WO2006/103103

PCT Pub. Date: Oct. 5, 2006

(65) Prior Publication Data

US 2012/0096696 A1 Apr. 26, 2012

(30) Foreign Application Priority Data

Apr. 1, 2005 (DE) ..... 10 2005 014 998

(51) Int. Cl.
*B21K 1/08* (2006.01)
*B21D 15/00* (2006.01)

(52) U.S. Cl. ..... 29/6.01; 72/110

(58) Field of Classification Search ..... 29/6.01; 72/110

See application file for complete search history.

(56) References Cited

U.S. PATENT DOCUMENTS

| | | | | |
|---|---|---|---|---|
| 4,747,286 | A * | 5/1988 | Berstein et al. | 72/110 |
| 4,766,753 | A * | 8/1988 | Berstein et al. | 72/110 |
| 5,138,859 | A * | 8/1992 | Winkens | 72/110 |
| 5,445,003 | A * | 8/1995 | Gottschalk et al. | 72/110 |
| 5,493,761 | A * | 2/1996 | Bone | 29/6.01 |
| 5,943,893 | A * | 8/1999 | Goedderz et al. | 72/110 |
| 6,393,887 | B1 * | 5/2002 | Steffens et al. | 72/110 |
| 6,691,543 | B2 * | 2/2004 | Steffens et al. | 72/110 |
| 2005/0066699 | A1 * | 3/2005 | Bagusche | 72/110 |
| 2005/0144999 | A1 * | 7/2005 | Heimann | 72/110 |

FOREIGN PATENT DOCUMENTS

EP 0 881 041 A2 12/1998

* cited by examiner

*Primary Examiner* — David Bryant
*Assistant Examiner* — Jacob Cigna
(74) *Attorney, Agent, or Firm* — Harness, Dickey & Pierce, P.L.C.

(57) ABSTRACT

A deep rolling machine has a power unit (13) attached in a gate (31) such that the power unit (13) can be moved in the direction of force exertion (30). The power unit (13) is connected, with articulation, at one end (32), via a joint (33), to the end (11) of a shearing arm (3) of the deep rolling unit (15). The free end (34) of the gate (31) is fit with a back up roller (35) that is routed along a curved web (36), defined in a gap in the second end (11) of the shearing arm (3). In the closed position of the power unit (13), three joints (28, 29, 33) form a triangle (37). One of the joints (28) points to the rotating joint (5). The two shearing arms (3 and 4) of the deep rolling unit (15) are articulately connected to one another at the rotating joint (5). Also in the closed position, a crank lever (27) reaches a limit stop (39) at the end (12) of the shearing arm (4).

4 Claims, 2 Drawing Sheets

ROLLER BURNISHING MACHINE FOR CRANKSHAFTS

CROSS-REFERENCE TO RELATED APPLICATION

This application is a National Stage of International Application No. PCT/EP2006/003016, filed Apr. 3, 2006 which claims priority to German Application No. 10 2005 014 998.7, filed Apr. 1, 2005. The disclosures of the above applications are incorporated hereby by reference.

FIELD AND BACKGROUND

The disclosure illustrates a deep rolling machine for crankshafts.

Deep rolling machine, in particular a deep rolling unit, is known from the German utility patent DE 297 13 627 U1 and the corresponding European patent, EP 0 881 041 B1. The patent holder has been building deep rolling machines known from these patents for several years. They have proven very successful in use. At the same time, the existing machines have several features that prompt further development and improvement.

SUMMARY

Accordingly, it is an objective of the present disclosure to simplify and improve existing deep rolling machines. In accordance with the disclosure, this task is solved by the properties of a deep rolling machine for crankshafts that contains a rotary drive that rotates around an axis for a crankshaft to be deep rolled. It comprises at least one deep rolling unit flexibly attached to a suspension system and a shear-type construction with a first and a second shearing arm rotatably connected to one another via a first rotating joint. The first and second shearing arms carry parts of a deep rolling tool with a work roller head and a support roller head at first ends of the first and second shearing arms. The work and support roller heads face the axis opposite to one another. The steering arms are driven by a power unit on second ends of the shearing arms facing away from the axis. The suspension system can be moved along the axis of the rotary drive to the crankshaft and locked in position. The power unit has an opening width greater than twice a construction radius of the crankshaft to be deep rolled at the first ends of the two shearing arms. The power unit generates closing and opening movements and a deep rolling force by hinges connecting the second shearing arm to a first shank of a first crank lever. The first crank lever is attached via a second rotating joint to the suspension system. The second shank of the first crank lever is connected to a piston cylinder unit attached to the suspension system. The first end of the second shearing arm is supported via a roller on the suspension system. The power unit is articulately connected at a first end, via a second crank lever, to the second end of the second shearing arm, via a third and fourth joint. The power unit is attached within a gate such that the power unit can move in a direct of force exertion. The power unit is articulately connected at its second end, via a fifth joint, to the second end of the first shearing arm. A free end of the gate is fit with a back up roller. The free end is routed along a curved web defined by a gap at the second end of the first shearing arm. In the closed position of the deep rolling machine, the third, fourth and fifth joints form a triangle with one another. The third joint points to the first rotating joint. The second crank lever reaches the limit stop at the second end of the second shearing arm.

The deep rolling machine of the piston cylinder unit is connected to the suspension system via a resilient flexible element. The joints are fit between the second shank of the first crank lever and the resilient flexible element and the piston cylinder unit.

The deep rolling machine of the piston cylinder unit is charged with a liquid pressure medium.

The deep rolling machine of the power unit is charged with a liquid pressure medium.

A series of significant advantages arise from the solution of the present design that significantly reduce the peak height and the height above floor level of the axis of the rotary drive for the crankshaft. The peak height of the existing machines are 1,400 mm. The peak height of the present design is lowered to about 1,100 mm. Thus, the present design integrates better with the remaining machinery to process crankshafts since a lifting platform is not necessary. Additionally, lubrication of the deep rolling tools is also improved. Further, the routing of cables and hoses to the individual deep rolling unit of the deep rolling machine is simplified. Improvement to the weight balance of the deep rolling unit for the suspension system in the machine is achieved. Finally, the modifications enable a common pressure medium, compressed oil, to be used to operate both the power unit and the piston cylinder unit. The piston cylinder elastically supports the suspension of the deep rolling unit on the suspension system.

Further areas of applicability will become apparent from the following description. The description and specific examples in this summary are intended for purposes of illustration only and are not intended to limit the scope of the present disclosure.

DRAWINGS

The following figures are schematic and show on a smaller scale:

DETAILED DESCRIPTION

Figure 1:
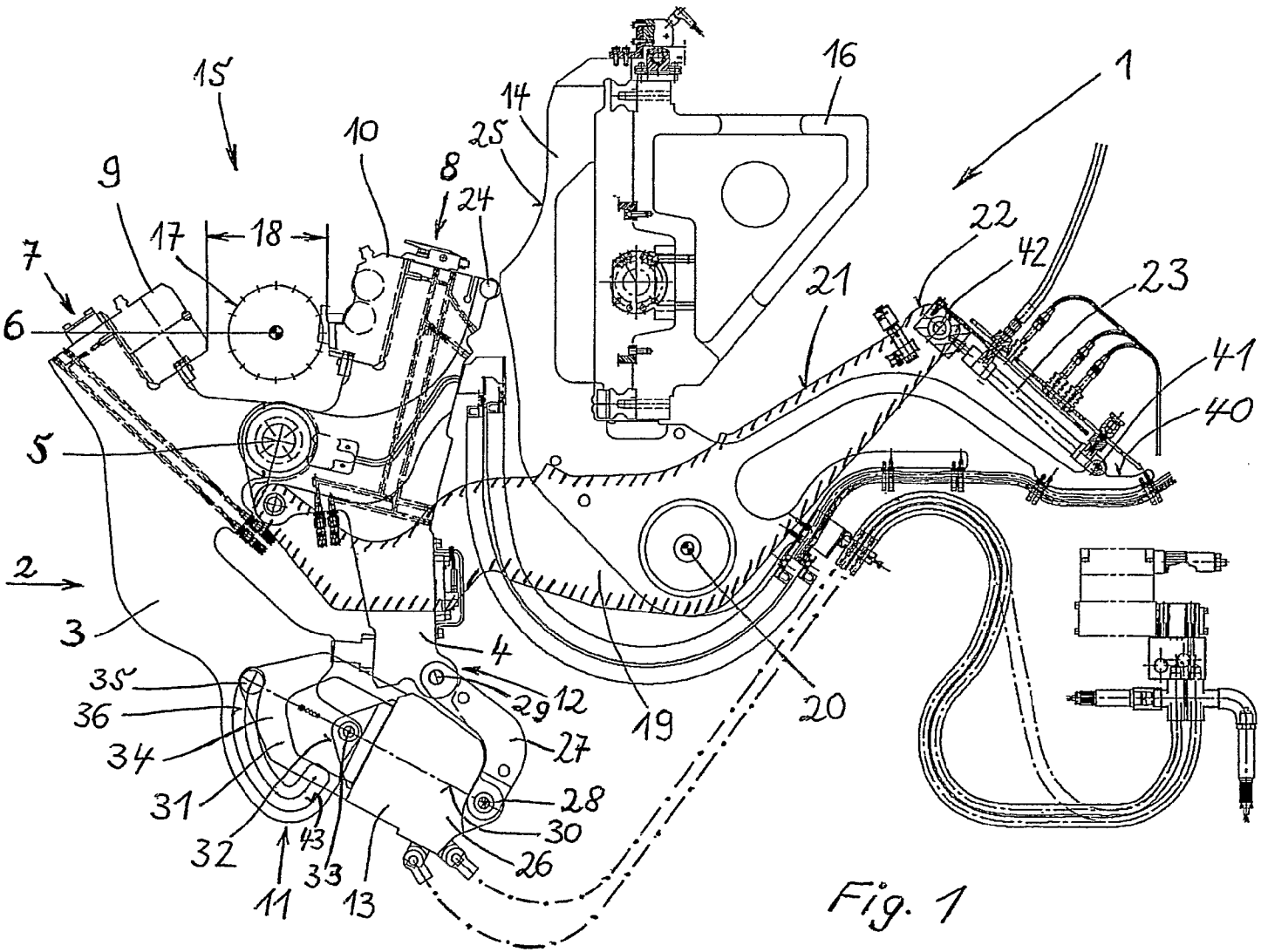
FIG. 1 is a side view of a deep rolling unit in an open position.

The deep rolling machine 1 is viewed from the operating side 2. A first and second shearing arm 3 and 4 are connected for articulation by a first rotating joint 5. The first shearing arm 3, the second shearing arm 4 and the first rotating joint 5 form a deep rolling unit of a shear-type construction. There are several units in the deep rolling machine 1.

The deep rolling machine 1 for crankshafts (not shown) has a rotary drive (not shown) for the crankshaft, which can be rotated around an axis 6. The two shearing arms 3 and 4 each carry parts of a deep rolling tool 15. A work roller head 9 is shown on shearing arm 3 and an oppositely positioned support roller head 10 is shown on shearing arm 4. The roller head 9 and support roller head 10 are at the first ends 7 and 8 of the shearing arms 3 and 4 facing the axis 6. The two shearing arms 3 and 4 at their second ends 11 and 12, facing away from the axis 6, are driven by a power unit 13 that is connected between the arms 3, 4.

A suspension system 14 follows each deep rolling unit 15 of the deep rolling machine 1. The suspension system 14 can be moved and locked in place along a crossbeam 16 on the deep rolling machine 1 in the direction of the axis 6.

The power unit 13, between the two second ends 11 and 12 of the shearing arms 3 and 4, generates a closing and opening movement as well as a deep rolling force of the deep rolling unit 15 at the corresponding first ends 7 and 8 of the two shearing arms 3 and 4. When the deep rolling unit 15 opens, the two first ends 7 and 8 open to an opening width 18 greater than twice the construction radius 17 of a crankshaft.

The second shearing arm 4 is hinged on a first shank 19 of a first crank lever 21 that is attached to the suspension system 14 with a pivot motion, via a second rotating joint 20. The second shank 22 of the first crank lever 21 is connected to a piston cylinder unit 23. The piston cylinder unit 23 is connected to the suspension system 14. The outline of the first crank lever 21 in FIG. 1 is drawn with hatching to increase the clarity.

The first end 8 of the second shearing arm 4 is supported on the suspension system 14, via a roller 24. The web 25 of the suspension system 14 is curved to receive the roller 24.

The first end 26 of the power unit 13 is articulately connected, via a second crank lever 27 and a third and fourth joint 28 and 29, to the second end 12 of the second shearing arm 4.

The power unit 13 is aligned in the direction of the exertion of force 30 within a gate 31 that it can move along. The second end 32 of the power unit 13 is articulately connected, via a fifth joint 33, to the second end 11 of the first shearing arm 3.

The free end 34 of the gate 31 is fit with a back up roller 35 that is routed along a curved web 36. A gap or slot is in the second end 11 of the first shearing arm 3 with its wall defining the curved web 36. If the power unit 13 increases the distance between its joints 28 and 33, the curved web 36 and the back up roller 35 change the position of the second crank lever 27 and the shearing arms 3 and 4 so that the ends 7 and 8 approach one another. This results in the image in FIG. 2.

Figure 2:
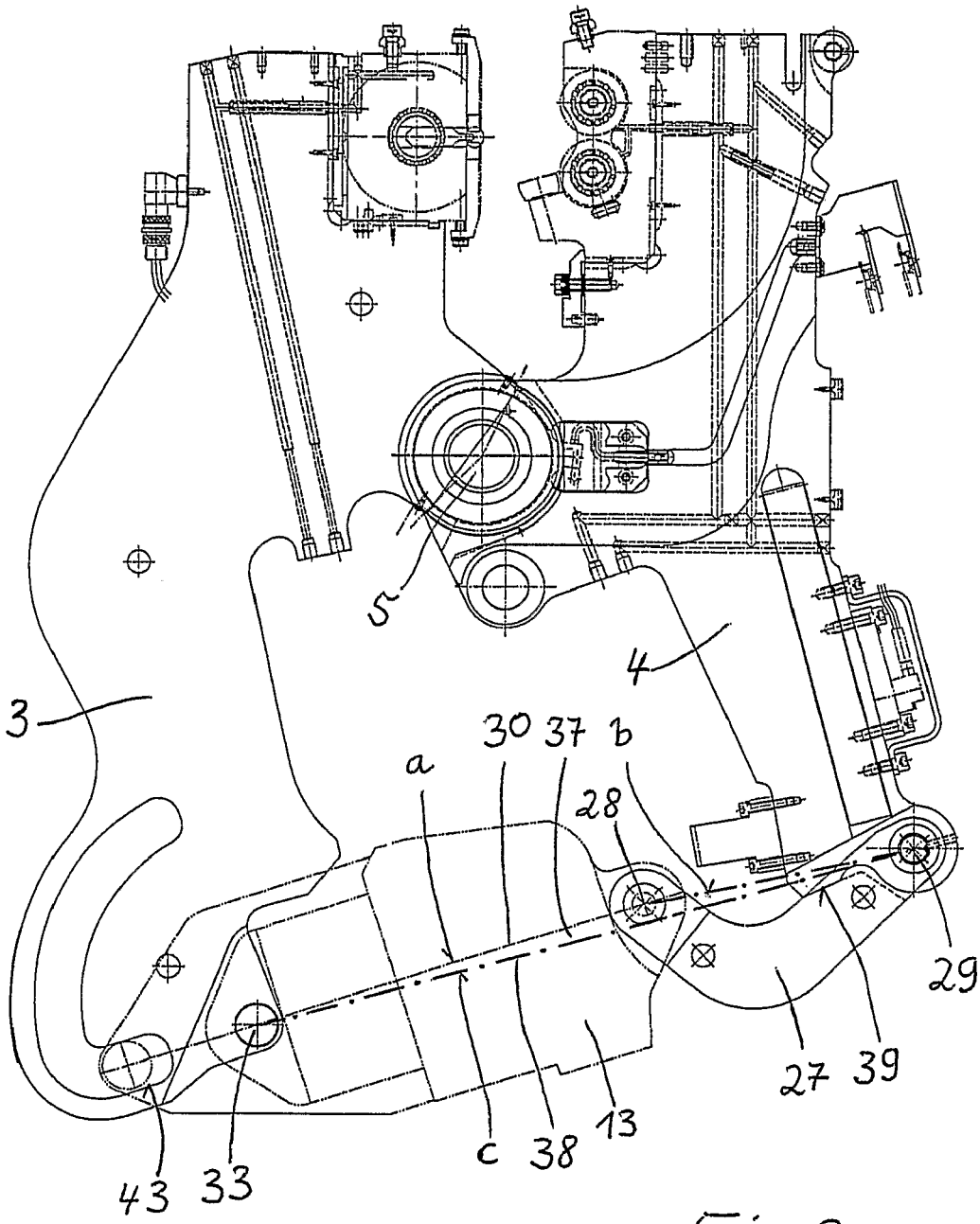
FIG. 2 is a side view of a deep rolling unit in a closed position.

In FIG. 2, the third 28, fourth 29 and fifth joints 33 form a triangle 37 when the deep rolling unit 15 is in the closed position. The sides a, b and c form the sides of the triangle. The direction of force exertion 30 between the third and fifth joints 28 and 33 forms one side (a) of the triangle 37. The other side of the triangle (c) is formed by the direct connection line 38 between the fourth and fifth joints 29 and 33. As a result of this layout, the third joint 28, as a corner of the triangle 37, points to the first rotating joint 5. In order to stabilise the closed position, a limit stop 39 is also incorporated. The limit stop 39 is reached by the second crank lever 27 on the second end 12 of the second shearing arm 4. The curved web 36 is designed such that it generates a constant torque while the deep rolling unit 15 closes. The curved web 36 has a straight section 43 that acts as the working area of the power unit 13 for deep rolling.

The suspension system 14 protrudes beneath the crossbeam 16 and ends in a resiliently flexible element 40. The piston cylinder unit 23 is connected to the suspension system 14, via the resiliently flexible element 40. Joints 41 and 42 are located between the second shank 22 of the first crank lever 21 and the resiliently flexible element 40 and the piston cylinder unit 23. In the state-of-the-art mentioned above, a power element comparable to the piston cylinder unit 23 was charged with a gaseous pressure medium due to the required elasticity of the suspension of the deep rolling unit. Here this is achieved by charging the piston cylinder unit 23 with a liquid pressure medium such as hydraulic oil. This is due to the elasticity of the resiliently flexible element 40. This is the same pressure medium used to operate the power unit 13. The advantage of this arrangement is that only a single, liquid pressure medium is required for the deep rolling machine 1. The previous state-of-the-art deep rolling machine required two pressure media, a gaseous medium and a liquid medium.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A deep rolling machine for crankshafts that contains a rotary drive that rotates around an axis for a crankshaft to be deep rolled comprising:

at least one deep rolling unit flexibly attached to a suspension system, a shear-type construction with a first and a second shearing arm rotatably connected to one another via a first rotating joint, said first and second shearing arms carry parts of a deep rolling tool with a work roller head and a support roller head at first ends of said first and second shearing arms, said work and support roller heads facing the axis opposite one another, said shearing arms are driven by a power unit on second ends of the shearing arms facing away from the axis;

said suspension system can be moved along the axis of the rotary drive for the crankshaft and locked in position;

said power unit has an opening width greater than twice a construction radius of the crankshaft to be deep rolled at the first ends of the two shearing arms, said power unit generates closing and opening movements and a deep rolling force by hinges connecting the second shearing arm to a first shank of a first crank lever, said first crank lever is attached via a second rotating joint to the suspension system, said second shank of the first crank lever is connected to a piston cylinder unit attached to the suspension system, the first end of the second shearing arm is supported via a roller on the suspension system, the power unit is articulately connected at a first end via a second crank lever to the second end of the second shearing arm via a third and fourth joint;

the power unit is attached within a gate such that the power unit can move in a direction of force exertion;

the power unit is articulately connected at its second end, via a fifth joint, to the second end of the first shearing arm;

a free end of the gate is fit with a back up roller, said free end is routed along a curved web, defined by a gap at the second end of the first shearing arm;

in the closed position of the deep rolling machine, the third, fourth and fifth joint form a triangle with one another, said third joint points to the first rotating joint; and said second crank lever reaches a limit stop at the second end of the second shearing arm.

2. The deep rolling machine according to claim 1, wherein the power unit is charged with a liquid pressure medium.

3. The deep rolling machine according to claim 1, wherein the piston cylinder unit is connected to the suspension system via a resilient flexible element and joints are fit between the second shank of the first crank lever and the resiliently flexible element and the piston cylinder unit.

4. The deep rolling machine according to claim 3, wherein the piston cylinder unit is charged with a liquid pressure medium.

* * * * *